US008973660B2

(12) United States Patent
DiFoggio

(10) Patent No.: US 8,973,660 B2
(45) Date of Patent: Mar. 10, 2015

(54) APPARATUS, SYSTEM AND METHOD FOR INJECTING A FLUID INTO A FORMATION DOWNHOLE

(75) Inventor: Rocco DiFoggio, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 741 days.

(21) Appl. No.: 13/182,144

(22) Filed: Aug. 12, 2011

(65) Prior Publication Data

US 2013/0037270 A1 Feb. 14, 2013

(51) Int. Cl.

| | |
|---|---|
| ***E21B 43/16*** | (2006.01) |
| ***E21B 43/00*** | (2006.01) |
| ***E21B 49/10*** | (2006.01) |
| ***E21B 49/00*** | (2006.01) |
| ***E21B 49/08*** | (2006.01) |

(52) U.S. Cl.

CPC ..... *E21B 49/10* (2013.01); *E21B 49/008* (2013.01); *E21B 49/087* (2013.01)

USPC ..... 166/308.1; 166/90.1

(58) Field of Classification Search

CPC ... E21B 36/00; E21B 36/001; E21B 43/2405; E21B 43/26; E21B 49/087; E21B 49/10

USPC ..... 166/302, 308.1, 264, 271, 100, 250.02, 166/250.1, 57; 73/152.18

See application file for complete search history.

(56) References Cited

U.S. PATENT DOCUMENTS

| | | | | |
|---|---|---|---|---|
| 2,935,133 | A | 5/1960 | Eckel | |
| 3,284,281 | A | 11/1966 | Thomas | |
| 3,581,821 | A | 6/1971 | Ross | |
| 4,003,432 | A | 1/1977 | Paull | |
| 4,476,932 | A | 10/1984 | Emery | |
| 4,589,491 | A | 5/1986 | Perkins | |
| 4,660,643 | A | 4/1987 | Perkins | |
| 5,027,896 | A * | 7/1991 | Anderson | 166/251.1 |
| 5,653,287 | A * | 8/1997 | Wilson et al. | 166/302 |
| 7,516,787 | B2 | 4/2009 | Kaminsky | |
| 2007/0284099 | A1 * | 12/2007 | DiFoggio et al. | 166/264 |
| 2008/0066536 | A1 * | 3/2008 | Goodwin et al. | 73/152.24 |

(Continued)

FOREIGN PATENT DOCUMENTS

| | | | |
|---|---|---|---|
| WO | 2010008994 | A2 | 1/2010 |
| WO | WO 2013009567 | A3 * | 3/2013 |

OTHER PUBLICATIONS

M.H.H. Hettema, B. Bostrom, T. Lund, Statoil ASA, Analysis of Lost Circulation During Drilling in Cooled Formations, Sep. 26-29, 2004, 12 Pages, SPE Annual Technical Conference and Exhibition, Houston, TX.

(Continued)

*Primary Examiner* — Daniel P Stephenson

(74) *Attorney, Agent, or Firm* — Mossman, Kumar & Tyler, PC

(57) ABSTRACT

A method is disclosed, including but not limited to positioning a tool containing an injection liquid in a well bore formed in a formation; injecting the injection liquid through a probe into the formation; and withdrawing formation fluid from the formation through the probe. A system is disclosed for performing functions useful in positioning a tool containing an injection liquid in a well bore formed in a formation; injecting the injection liquid through a probe into the formation; and withdrawing formation fluid from the formation through the probe.

19 Claims, 5 Drawing Sheets

(56) References Cited

U.S. PATENT DOCUMENTS

| | | | | |
|---|---|---|---|---|
| 2008/0277162 | A1* | 11/2008 | DiFoggio | 175/17 |
| 2008/0314587 | A1 | 12/2008 | Del Campo | |
| 2009/0193889 | A1 | 8/2009 | Waid | |
| 2009/0211752 | A1* | 8/2009 | Goodwin et al. | 166/250.02 |
| 2009/0272528 | A1 | 11/2009 | Voelker | |
| 2010/0006284 | A1* | 1/2010 | Sonne et al. | 166/264 |
| 2010/0264915 | A1* | 10/2010 | Saldungaray et al. | 324/303 |
| 2010/0294493 | A1* | 11/2010 | Goodwin et al. | 166/264 |
| 2011/0198078 | A1* | 8/2011 | Harrigan et al. | 166/254.2 |
| 2012/0272727 | A1* | 11/2012 | Sanderlin et al. | 73/32 A |
| 2013/0037270 | A1* | 2/2013 | DiFoggio | 166/305.1 |
| 2014/0027112 | A1* | 1/2014 | Irani et al. | 166/250.1 |

OTHER PUBLICATIONS

Ibrahim Kocabas, An Analytical Model of Temperature and stress Fields During Cold-Water Injection into a Oil Reservoir, May 2006, pp. 282-292, vol. 21 No. 2, SPE Production and Operations, Houston, TX.

K.M. Abdalkadeer and E, Senturk, Notional Oil Corporation of Libya; S. Dunn-Norman, Missouri University of Science and Technology; and H.E. Goodman, M. Prada, and N. Rivera, Chevron, changes in Near Wellbare Stress and Fracture Gradient Due to Cold Water Injection in a Sirte Basin Field, Libya, Oct. 19-21, 2009, 16 Pages, SPE/EAGE Reservoir characterization and Simulation Conference, Abu Dhabi, UAE.

* cited by examiner

APPARATUS, SYSTEM AND METHOD FOR INJECTING A FLUID INTO A FORMATION DOWNHOLE

CROSS REFERENCE TO RELATED APPLICATIONS

NONE

BACKGROUND

1. Technical Field

The present invention relates to injecting fluids into a formation from a downhole tool.

2. Related Information

As the availability of hydrocarbon deposits in the earth diminish, the cost of obtaining these hydrocarbons from the earth increases. Thus, as the cost increases the economic and social benefit increases for improved products and methods useful for planning when and where to feasibly pursue hydrocarbon production of a reservoir. A particular hydrocarbon reservoir may contain several hydrocarbon bearing formations. These reservoir formations may or may not be connected.

The cost and difficulty of producing or "the producibility" of earth borne hydrocarbons from a reservoir is related to the permeability of the hydrocarbon reservoir or formation in the earth. The producibility, that is, the difficulty and associated costs of obtaining these earth borne hydrocarbons can be determined by testing samples of hydrocarbons from a particular formation. The producibility of a formation is related to the mobility, density and viscosity of a hydrocarbon formation fluid sample taken from the formation. The viability of a formation is usually determined by pumping formation fluid sample from the formation and testing the sample in a formation evaluation tool.

SUMMARY OF THE DISCLOSURE

A method is disclosed, including but not limited to positioning a tool containing a liquid in a well bore formed in a formation; injecting the liquid through a probe into the formation; and withdrawing formation fluid from the formation through the probe. A system is disclosed for performing functions useful in positioning the tool containing a liquid in a well bore formed in a formation; injecting the liquid through a probe into the formation; and withdrawing formation fluid from the formation through the probe for evaluation.

DETAILED DESCRIPTION OF ILLUSTRATIVE EMBODIMENTS

Detailed Description

Figure 1:
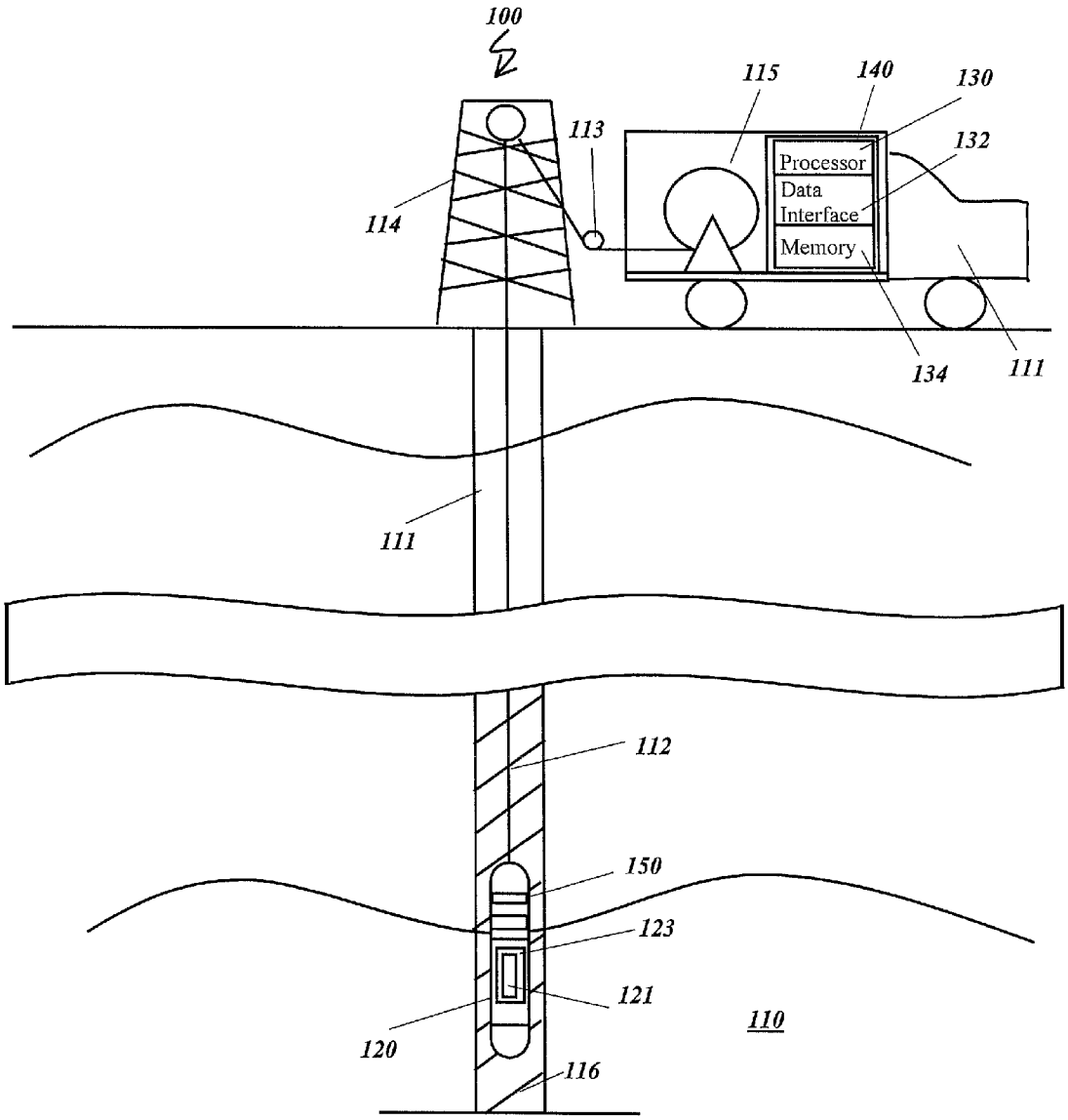
FIG. 1 is a schematic diagram of a particular illustrative embodiment deployed on a wire line in a downhole environment.

The present disclosure uses terms, the meaning of which terms will aid in providing an understanding of the discussion herein. As used herein, high temperature refers to a range of temperatures typically experienced in oil production well boreholes. For the purposes of the present disclosure, high temperature and downhole temperature include a range of temperatures from about 100 degrees Centigrade (212 degrees Fahrenheit) to about 200 degrees Centigrade (392 degrees Fahrenheit) and above. A "hot" formation is about 200 degrees Centigrade.

The term "carrier" as used herein means any device, device, component, combination of devices, media and/or member that may be used to convey, house, support or otherwise facilitate the use of another device, device component, combination of devices, media and/or member. Exemplary non-limiting carriers include sampling tools, wire lines and drill strings of the coiled tube type, of the jointed pipe type and any combination or portion thereof.

A "downhole fluid" as used herein includes any gas, liquid, flowable solid and other materials having a fluid property. A downhole fluid may be natural or man-made and may be transported downhole or may be recovered from a downhole location. Non-limiting examples of downhole fluids include but are not limited to drilling fluids, return fluids, formation fluids, production fluids containing one or more hydrocarbons, oils and solvents used in conjunction with downhole tools, water, brine and combinations thereof.

"Processor" as used herein means any device that transmits, receives, manipulates, converts, calculates, modulates, transposes, carries, stores or otherwise utilizes well information and electromagnetic information, discussed below. In several non-limiting aspects of the disclosure, a processor includes but is not limited to a computer that executes programmed instructions stored on a tangible non-transitory computer readable storage medium for performing various functions and methods.

Portions of the present disclosure, detailed description and claims may be presented in terms of logic, software or software implemented illustrative embodiments that are encoded on a variety of tangible non-transitory computer readable storage media including, but not limited to tangible non-transitory machine readable media, program storage media or computer program products. Such media may be handled, read, sensed and/or interpreted by an information processing device. Those skilled in the art will appreciate that such media may take various forms such as cards, tapes, magnetic disks (e.g., floppy disk or hard disk drive) and optical disks (e.g., compact disk read only memory ("CD-ROM") or digital versatile (or video) disk ("DVD")). Any embodiment disclosed herein is for illustration only and not by way of limiting the scope of the disclosure or claims.

The present disclosure describes an injection liquid storage tank contained in a formation evaluation tool. In a particular embodiment, the formation evaluation tool is Reservoir Characterization Instrument™ (hereinafter RCI™) by Baker Hughes Incorporated. The formation evaluation tools typically are used to withdraw formation fluid or downhole from the well bore or formation surrounding the well bore. The formation evaluation tool includes but is not limited to a sampling tooling and pump for injecting an injection liquid from the injection liquid storage tank into a formation downhole. The injection liquid storage tank is incorporated into an existing formation evaluation tool. In one embodiment, a formation evaluation tool containing a cooling device and a cold injection liquid is placed within a carrier and positioned downhole in a well bore drilled into a hot formation. In one embodiment, the cold liquid can be ice water stored in an insulated liquid container and quickly positioned downhole and injected into the hot formation. In one embodiment the formation evaluation tool is performs an initial mobility test in a well bore drilled in "hot" formation approaching about 200 degrees Centigrade. The initial mobility test is performed by pumping fluid from the formation through a probe attached to the formation evaluation tool. The downhole fluid can substantially consist of formation fluid, which may be in the form of a gas. In a particular embodiment, the RCI™ formation evaluation tool is used to perform the mobility test and contains the injection liquid storage tank, pump and probe through which the injection liquid is injected into the formation. The cold injection fluid is then injected into the formation through the same probe on the formation evaluation tool and at the same position in the well bore as used for the mobility test. In a preferred embodiment, the cold liquid is rapidly injected into the formation to facilitate thermally fracturing the formation. The colder the injection liquid injected into the formation, the more likely it is to induce a thermal shock in the hot formation and cause thermal fracturing of the hot formation. In one embodiment, the injection fluid is ice water at 0 degrees Centigrade and the formation temperature is about 200 degrees Centigrade.

The larger the volume of the liquid injected into the formation, the more likely it is to induce a thermal shock in the formation and cause thermal fracturing of the formation. The higher injection rate (i.e., liters/sec) with which the liquid is injected into the formation, the more likely it is to induce a thermal shock in the formation and cause thermal fracturing in the formation. As discussed below, an expert system running on the processor records and learns the temperature, volume or injection rate for a given formation and formation temperature to induce thermal fracturing of the formation. The expert system is initially trained with historic data including but not limited to temperature, injected fluid volume, injection rate and mobility for a given formation and formation temperature to induce thermal fracturing of the formation. The expert system thereafter keeps track of temperature, injected fluid volume, injection rate and mobility for a given formation and formation temperature to induce thermal fracturing of the formation. Thus, the expert system continues to train and learn temperature, injected fluid volume and injection rate for a given formation and formation temperature to induce thermal fracturing of the formation.

The "cold" injection liquid is relatively cold compared to the hot formation. In a preferred embodiment, the temperature differential between the hot formation and the cold fluid is of sufficient magnitude to induce a thermal fracture in the hot formation when the cold fluid is injected into the hot formation surrounding the well bore. In another embodiment the temperature differential is about 200 degrees Centigrade. A second mobility test is then conducted to determine the effects of the thermal fracturing on the formation. The mobility for the formation at the position of the probe on the formation evaluation tool is defined as the ratio of the formation permeability to the fluid viscosity. The RCI™ is a well known formation evaluation tool for measuring mobility. A mobility measurement can be made before and after cold water is injected into the formation to observe the resulting increase in mobility. In combination with a downhole fluid viscosity sensor, the formation permeability before and after treatment can be determined. Thus, in a preferred embodiment, the RCI™ formation evaluation tool is used as a carrier for the injection liquid storage tank. In a preferred embodiment, the RCI™ formation evaluation tool can also be used to perform mobility, permeability and viscosity testing for a formation into which the injection liquid from the injection liquid storage tank is injected.

In another embodiment, an initial mobility test is performed by the formation evaluation tool in a formation using a probe attached to the formation evaluation tool. In this embodiment, without changing the position of the formation evaluation tool, a completion fluid stored in the injection liquid storage tank is then injected through the probe into the formation surrounding the well bore. A second mobility test is then conducted at the same position to determine the effects of the injected completion fluid on the formation. In another embodiment two injection liquid storage tanks are provided, one for the cold injection liquid and another one for the completion fluid. In this embodiment, after an initial mobility test, either the cold injection liquid is injected into the formation to induce thermal fracturing or a completion fluid is injected into the formation or one after the other. A second (or third) mobility test is then performed to assess the effect of the treatment on the formation. A desirable completion fluid, whose chemistry is compatible with the mineralogy of the formation, will not significantly reduce the mobility of the formation after injection therein.

FIG. 1 is a schematic representation of a wireline formation testing system 100 for injecting an injection liquid into a formation 110 downhole. FIG. 1 shows a wellbore 111 drilled in the formation 110. The well bore 111 is shown filled with a drilling fluid 116, which is also is referred to as "mud" or "well bore fluid." The term "connate fluid" or "natural fluid" herein refers to the fluid that is naturally present in the formation, exclusive of any contamination by the fluids not naturally present in the formation, such as the drilling fluid. A formation evaluation tool 120 such as the Baker Hughes Incorporated RCI™ is conveyed into the well bore 111 at the bottom end of a wire line 112. The formation evaluation tool can include but is not limited to an analysis module 150 and an injection liquid storage tank 121 for storing an injection liquid that will be injected into the formation. In one particular embodiment, a cooling system 123 is provided to keep the injection liquid at a desired temperature in the injection liquid storage tank. The cooling and cold storage system may include an insulator, a sorption cooling unit, a passive thermal rectifier, an active thermal rectifier, a passive heat pump or an active heat pump. The formation evaluation tool 120 acts as a housing for the injection liquid storage tank 121. The injection liquid storage tank contains a fluid for injection into the formation. A test cell 122 is also provided for analyzing formation fluid withdrawn from the formation. The wire line 112 is typically an armored cable that carries data and power conductors for providing power to the formation evaluation tool 120 and a two-way data communication link between a tool processor in the analysis module 150 and a surface controller 140 placed in surface unit, which may be a mobile unit 111, such as a logging truck. The surface controller and analysis module 150 each can include but are not limited to a processor 130, data interface 132 and non-transitory computer readable media 134.

The wire line 112 is typically carried from a spool 115 over a pulley 113 supported by a derrick 114. In one embodiment, the controller 140 and analysis module 150 are a computer-based system, which may include one or more processors such as a microprocessor, that may include but is not limited to one or more non-transitory computer readable medium data storage devices, such as solid state memory devices, hard-drives, magnetic tapes, etc.; peripherals, such as data input devices and display devices; and other circuitry for controlling and processing data received from the formation evaluation tool 120. The surface controller 140 and analysis module 150 may also include but is not limited to one or more computer programs, algorithms, and computer models, which may be embedded in the non-transitory computer-readable storage medium that is accessible to the processor for executing instructions and information contained therein to perform one or more functions or methods associated with the operation of the formation evaluation tool 120.

The test cell 122 can include but is not limited to a downhole fluid sample tank and a flow line 211 for downhole fluid to flow into the sample tank. The test cell may be any suitable downhole fluid test cell in accordance with the disclosure. Non-limiting examples of a test cell include but are not limited to a downhole fluid sample chamber and a downhole fluid flow line. Additional downhole test devices can be provided for estimating a property of the downhole fluid. The additional downhole test devices can be included in the formation evaluation tool 120. In another embodiment, any test device can be included in accordance with disclosure, including but not limited to nuclear magnetic resonance (NMR) spectrometers, pressure sensors, temperature sensors and electromechanical resonators, such as electrically drive piezoelectric resonators. In one embodiment, the cooling unit 123 is an insulator, such as a Dewar flask. In another embodiment, the cooling unit 123 is a downhole sorption cooling unit as disclosed in U.S. Pat. No. 7,540,165 to DiFoggio entitled Downhole Sorption Cooling and Heating in Wire Line Logging and Monitoring While Drilling. In another embodiment the cooling unit is a passive thermal rectifier as disclosed in U.S. Patent Publication 20080277162 to DiFoggio entitled System and Method for Controlling Heat Flow in a Downhole Tool. In another embodiment, the cooling unit is an active heat pump. In another embodiment, the cooling unit is thermoelectric device for removing heat as disclosed in U.S. Patent Publication 20080277162 to DiFoggio entitled System and Method for Controlling Heat Flow in a Downhole Tool. The cooling unit may be a combination of the cooling units described herein or another cooling unit sufficient to maintain a desired temperature differential between the temperature of the injection liquid in the injection liquid storage tank and the temperature of the formation. The liquid storage tanks may be thermally insulated to substantially increase the time that the liquid storage tank can store a cold fluid in a hot environment.

Figure 2:
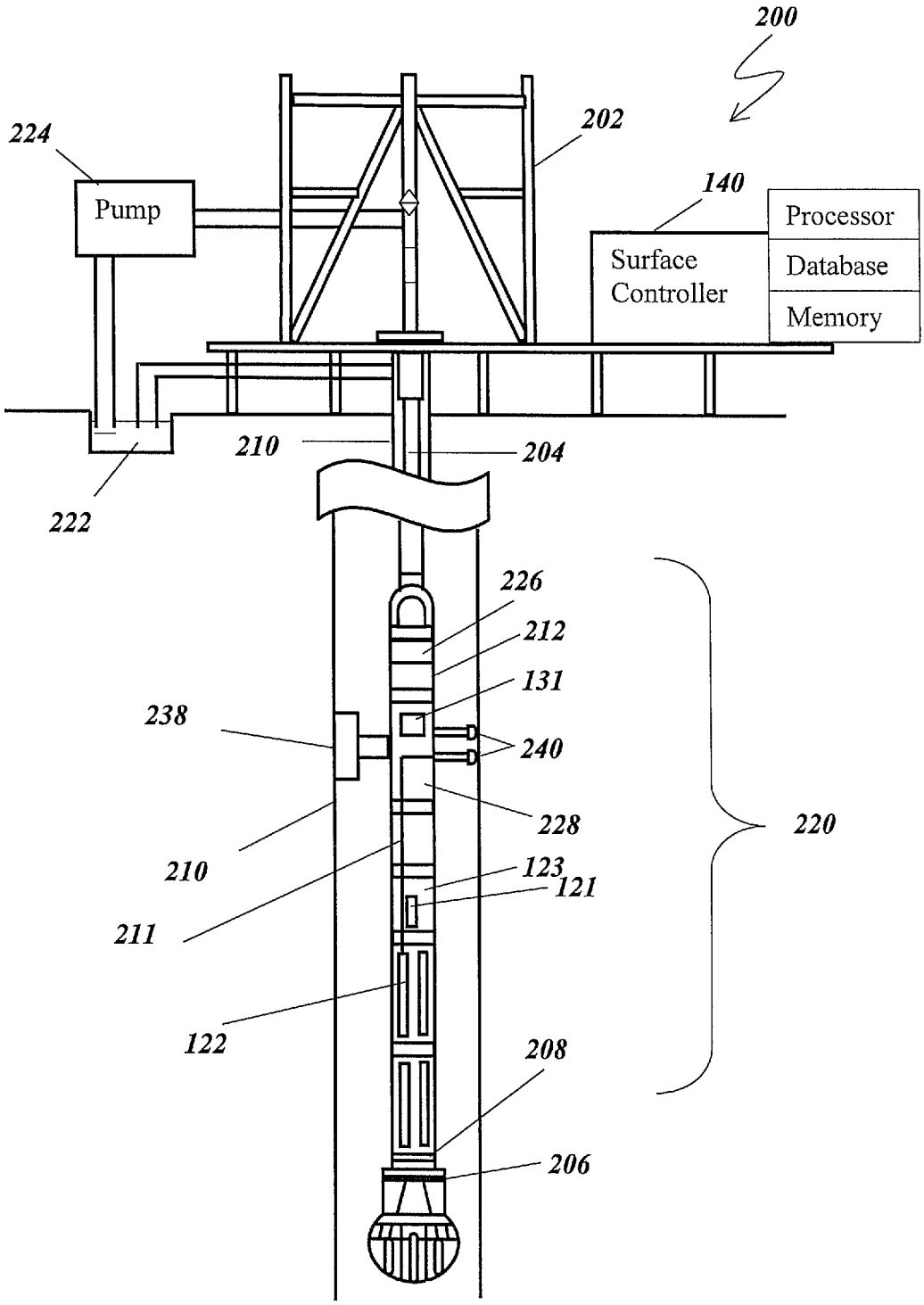
FIG. 2 is a schematic diagram of another particular illustrative embodiment deployed on a drill string in a monitoring while drilling environment.

Turning now to FIG. 2, FIG. 2 depicts a non-limiting example of a drilling system 200 in a measurement-while-drilling (MWD) arrangement according to one embodiment of the disclosure. A derrick 202 supports a drill string 204, which may be a coiled tube or drill pipe. The drill string 204 may carry a bottom hole assembly (BHA) 220 and a drill bit 206 at a distal end of the drill string 204 for drilling a borehole 210 through earth formations. Drilling operations according to several embodiments may include pumping drilling fluid or "mud" from a mud pit 222, and using a circulation system 224, circulating the mud through an inner bore of the drill string 204. The mud exits the drill string 204 at the drill bit 206 and returns to the surface through an annular space between the drill string 204 and inner wall of the borehole 210.

In the non-limiting illustrative embodiment of FIG. 2, the bottom hole assembly 220 may include a formation evaluation tool 120, a power unit 226, a tool processor 212 and a surface controller 140. Any suitable power unit may be used in accordance with the disclosure. Non-limiting examples of suitable power units include but are not limited to a hydraulic, electrical, or electro-mechanical and combinations thereof. The formation evaluation tool 120 may carry a fluid extractor 228 including a probe 238, pump 131 and opposing feet 240. In several embodiments to be described in further detail below, the tool 120 includes but is not limited to an injection liquid storage tank 121. A flow line 211 connects fluid extractor probe 238 and pump 131 to test cell 122 and injection liquid storage tank 121. The injection liquid storage tank may be used to inject a fluid into the formation in either the while-drilling embodiments or in the wireline embodiments. The formation evaluation tool is provided as a carrier for the injections of an injection liquid into the formation and also for an a priori and subsequent in situ or surface estimation of a property of a fluid downhole fluid. The formation evaluation tool is provided as a carrier for the injections of an injection liquid into the formation and also for an a priori and subsequent in situ or surface estimation of a property of the formation.

Those skilled in the art with the benefit of the present disclosure will recognize that the several embodiments disclosed are applicable to a formation fluid production facility without the need for further illustration. The several examples described below may be implemented using a wireline system as described above and shown in FIG. 1, may be implemented using a while-drilling system as described above and shown in FIG. 2 or may be implemented in a production facility.

Figure 3:
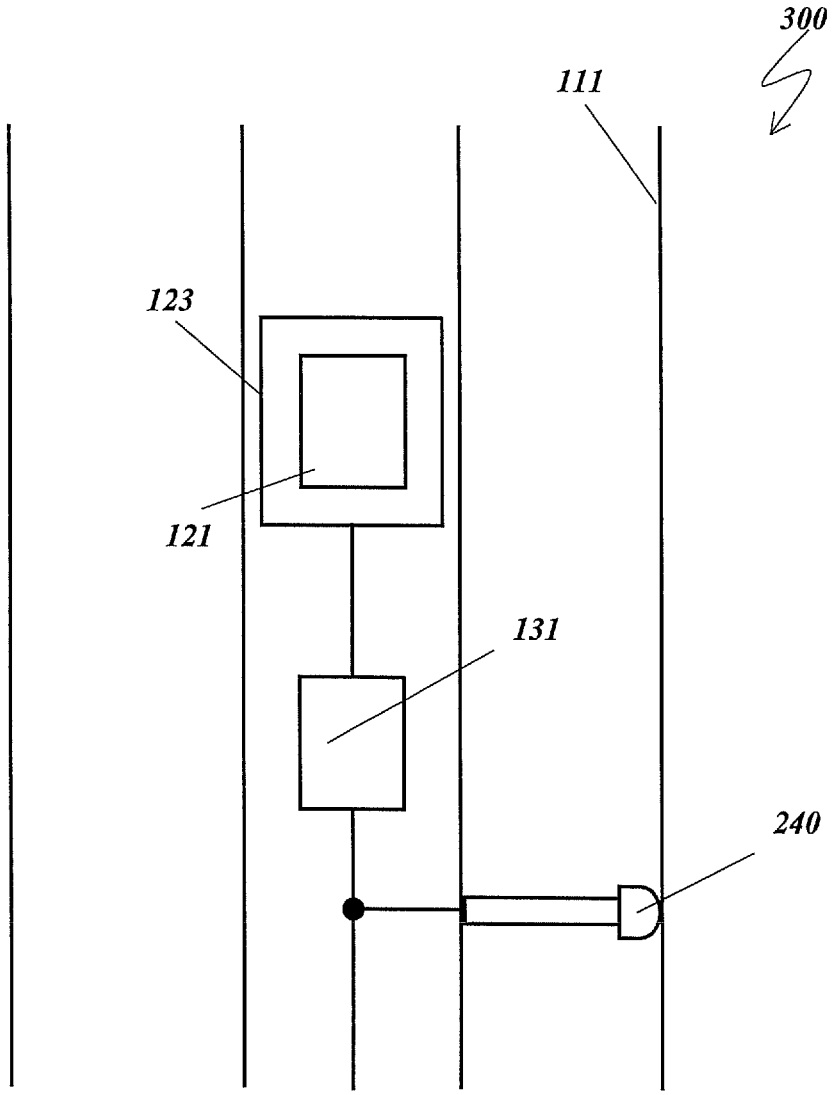
FIG. 3 is a schematic diagram of a particular illustrative positioned in a well bore downhole for injecting a liquid into a formation.

Turning now to FIG. 3, in a particular illustrative embodiment, a formation evaluation tool is positioned downhole in the well bore. The cold injection liquid is stored in the injection liquid storage tank, which is preferably thermally insulated. The "cold" injection liquid is referred to as "cold" because preferably the injection liquid is maintained at a temperature that is substantially cooler than the "hot" formation surrounding the well bore. In a preferred embodiment the cold injection liquid is maintained at 0 degrees Centigrade in the injection liquid storage tank until the cold injection liquid is rapidly injected into the hot formation which is about 200 degrees Centigrade. The thermal fracturing technique described herein is more effective in the "hot" well where the formation temperature is about 200 degrees Centigrade. In one embodiment the cold liquid is ice water placed in the liquid storage tank and maintained within a desired temperature range by the cooling unit 123. In one embodiment, the cooling unit can include but is not limited to a Dewar flask.

In a preferred embodiment, the RCI™ formation evaluation tool is used to perform an initial mobility test by pumping fluid from the formation via probe 240 under the influence of a reduction in pressure created by pump 131. In a particular embodiment the RCI™ is then used to determine a ratio of permeability to fluid viscosity, which in one embodiment is calculated during a controlled drawdown of formation fluid into the fluid sample tank 122. The mobility test on the formation is then conducted by execution of a computer program in a non-transitory computer readable medium by control module 150. The control module contains a processor 130 which executes a computer program stored in the non-transitory computer readable medium 132 to perform the mobility test and other functions useful in accomplishing the methods and functions disclosed herein. After the initial mobility test has been performed, without moving the formation evaluation tool or the probe, a predetermined volume the cold injection liquid is rapidly injected into the hot formation via the probe 240 and a second mobility test is them conducted and compared to the initial mobility test. In a particular embodiment, the volume of cold injection fluid and rate of injection are determined by an expert system based on prior training of the expert system and learning by the expert system. The expert system thus determines the volume of cold injection fluid and rate of injection based a temperature of the formation. The effectiveness of the thermal fracture can be estimated from a comparison of the initial mobility test before the thermal fracture and the second mobility test after the thermal fracture.

In another embodiment, the injection liquid storage tank contains a completion fluid. An initial mobility test is conducted by withdrawing downhole fluid from the formation via probe 240 under the influence of a reduction in pressure created by pump 131. A formation mobility (ratio of permeability to fluid viscosity) is calculated during a controlled drawdown of formation fluid into sample tank 122. The mobility test is performed by control module 150. The control module contains a processor 130 which executes a computer program stored in the non-transitory computer readable medium 132 to perform the mobility test and other functions useful in accomplishing the methods and functions described herein.

After the initial mobility test, without moving the formation evaluation tool or the probe, the completion fluid is then injected into the formation via the probe 240 and a second mobility test is then conducted and compared to the initial mobility test. After the initial mobility test has been performed, without moving the formation evaluation tool or the probe, the completion fluid is injected into the hot formation via the probe 240 and a second mobility test is them conducted and compared to the initial mobility test. Thus, an effect of the completion fluid on the formation can be estimated from a comparison of the initial mobility test performed prior to injection the completion fluid into the formation and to the second mobility test performed after injection the completion fluid into the formation. In a preferred embodiment, the mobility is not reduced for a desirable completion fluid. Thus, the second mobility test after injecting the completion fluid into the formation should indicate no reduction in the mobility of the formation. In a case where the second mobility test after injecting a first completion fluid into the formation indicates a reduction in formation mobility, a second completion fluid can be injected and tested for its effect on the formation mobility. A compatible completion fluid can thus be selected which does not reduce the mobility of the formation.

Figure 4:
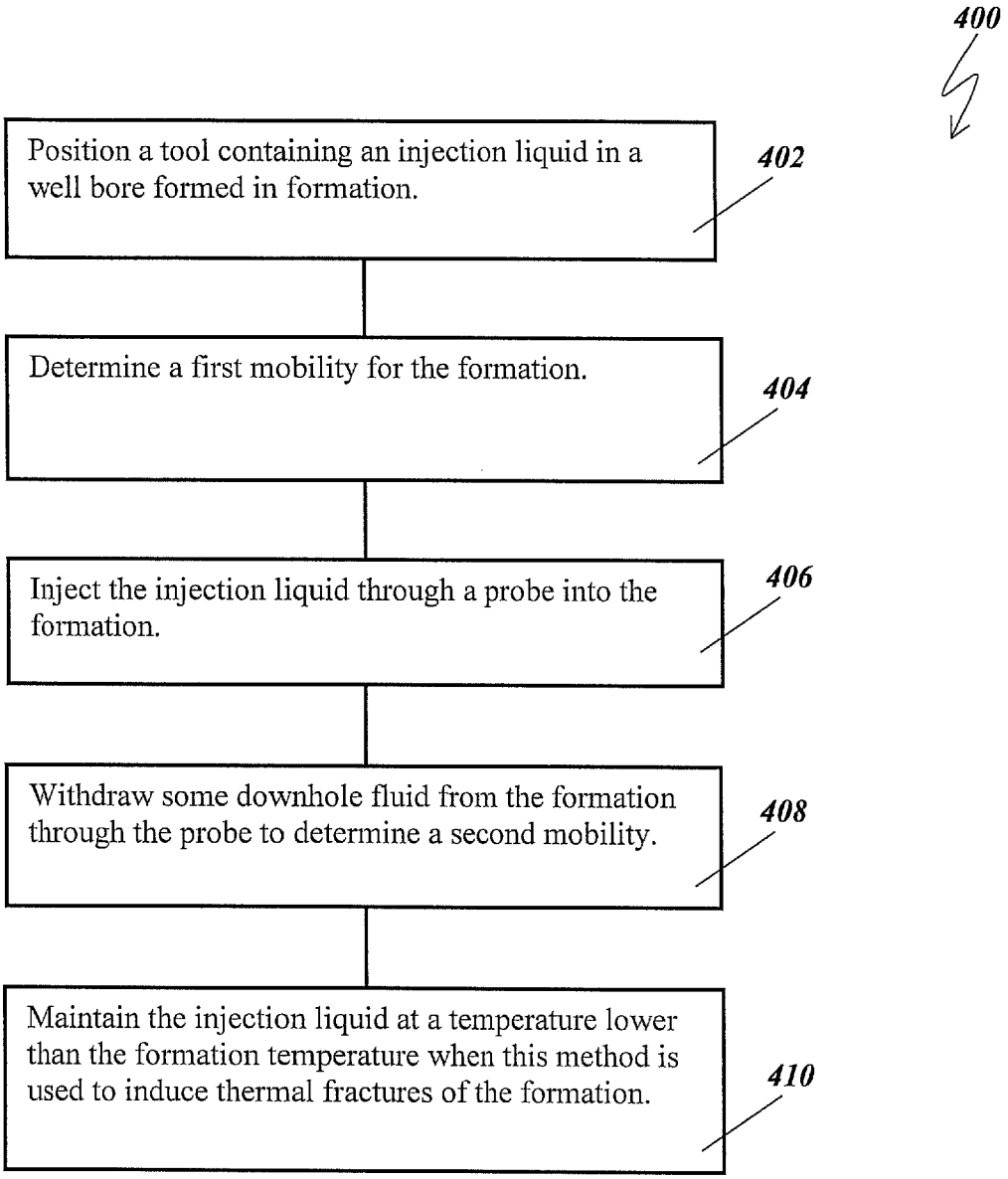
FIG. 4 is a flow chart of functions performed in an illustrative embodiment.

Turning now to FIG. 4, in a particular illustrative embodiment a method is performed including but not limited to 402 positioning a tool containing an injection liquid in a well bore formed in a formation. The method further includes but is not limited to 404 determining a first mobility for the formation. The method further includes but is not limited to 406 injecting the injection liquid through a probe into the formation. The method further includes but is not limited to 408 withdrawing a downhole fluid from the formation through the probe. In a particular embodiment, the injection liquid is at a temperature substantially lower than a temperature for the formation, for thermally fracturing the formation with the liquid. In the present example the injection liquid temperature is relatively cold compared to the temperature of the formation to thermally fracture the "hot" formation.

In a particular embodiment, the thermal fracturing includes but is not limited to rapidly lowering a temperature for a first volume of the formation adjacent the probe by injecting the cold injection liquid. The cold injection liquid causes the first volume of the formation to contract. The contraction of first volume is proportional to the thermal coefficient of expansion/contraction for the first volume of the formation. The contraction induced by the injection of cold injection liquid into the first volume of the formation induces a tension force between the thermally contracted first volume of the formation and a substantially un-contracted second volume of the formation adjacent the contracting first volume. Thus, when the cold injection fluid is rapidly injected into the hot formation, the first volume of the hot formation contracts and pulls away from the second un-contracted volume surrounding the first volume. Tension is induced between the contracting first volume and the second un-contracted volume and a thermal fracture is induced between the first volume and the second volume of the formation.

The method further includes but is not limited to 410 insulating the injection fluid in the tool to maintain the fluid at a temperature lower than the formation. In a particular embodiment, the injection fluid is "cold" water. The method further includes but is not limited to determining a second mobility for the formation to determine the effectiveness of the thermal fracture. The volume and temperature of the cold injection fluid, which can be ice water, injected into the hot formation is recorded along with the initial and second mobility test. The temperature of hot formation is also recorded. The injection rate is also recorded. These data are stored to assess the effectiveness of the cold liquid thermal fracturing.

In another embodiment, an expert system is initially trained from recorded historical data indicating cold injection liquid temperature, volume injected, temperature and injection rate for the cold injection liquid volume for injection into a formation at a given formation temperature. The trained expert system can then determine what temperature, volume, temperature and injection rate to apply to a formation at a given formation temperature to accomplish thermal fracturing of the formation. The expert system is trained by receiving inputs from prior thermal fracturing operations which indicate the temperature, volume of injection liquid and injection liquid injection rate for the volume of injection liquid into the formation for a given formation type and formation temperature to induce thermal fracturing in the formation.

Figure 5:
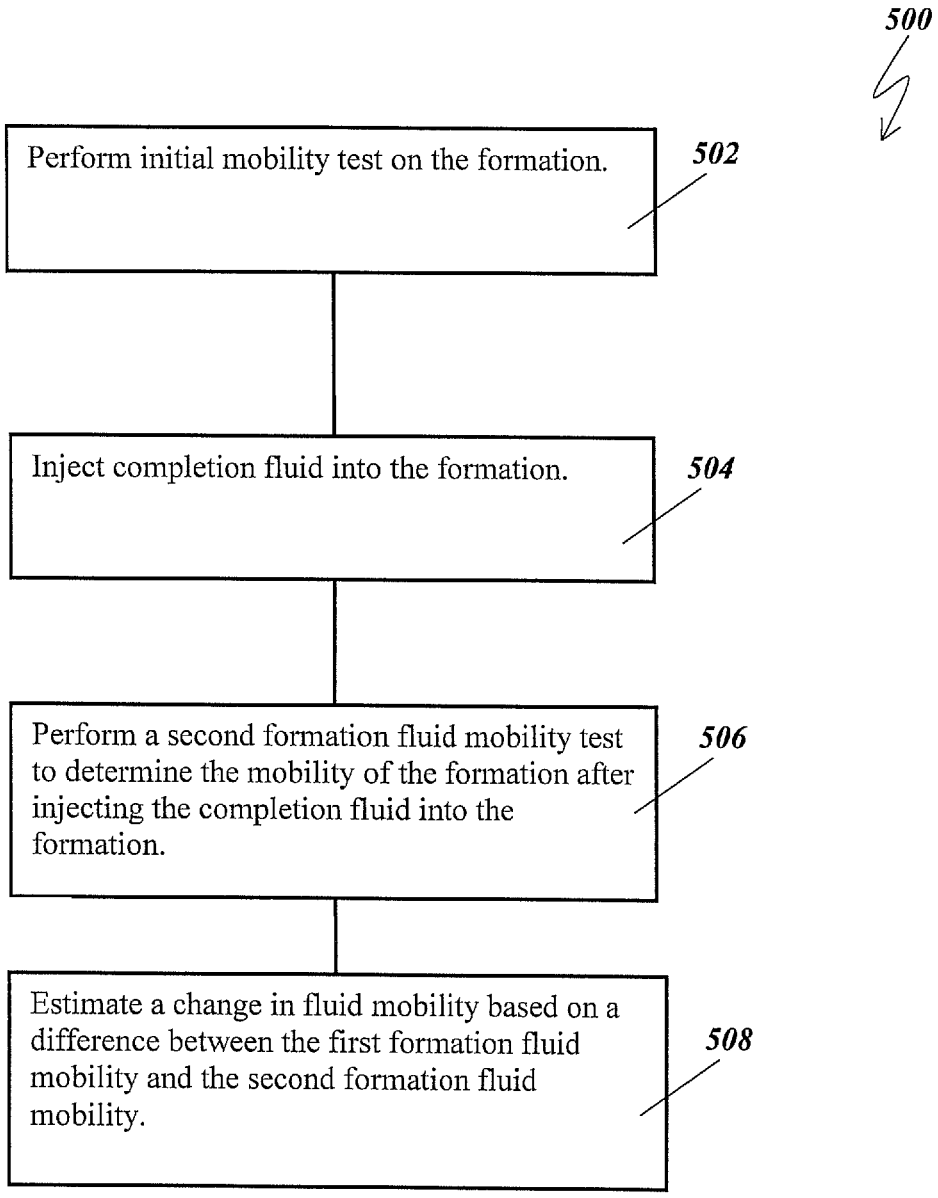
FIG. 5 is a flow chart of functions performed in an illustrative embodiment.

Turning now to FIG. 5, in another illustrative non-limiting embodiment, an injection liquid stored in the injection liquid storage tank is a completion fluid. An initial mobility test is performed 502 before injecting the completion fluid into the formation. The completion fluid is then injected into the formation 504. In this embodiment the method further includes but is not limited to performing a second formation fluid mobility test to determine the mobility of the formation after injecting the completion fluid into the formation 506. The method further includes but is not limited to 510 estimating a change in fluid mobility based on a difference between the first formation fluid mobility test result and the second formation fluid mobility test result. The difference between the results of the first formation fluid mobility test and the results of the second formation fluid mobility test indicate the effect of the injected completion fluid on the formation. As stated above, it is desirable that the completion fluid not reduce the mobility of the formation. If the mobility is reduced, a second different completion fluid can be injected into the formation and the mobility after the injection of the second completion fluid can be measured to determine if the second completion reduces the mobility of the formation. Completion fluids can help production of formation, however, selection of the wrong completion fluid may have a chemical or other type reaction with the formation and thus reduce the mobility of the formation. Different completion fluids can be injected and tested for a reduction in mobility until a suitable completion fluid is found that does not reduce the mobility of the formation.

The foregoing examples of illustrative embodiments are for purposes of example only and are not intended to limit the scope of the invention.

What is claimed is:

1. A method comprising:

positioning a formation evaluation tool containing an injection liquid in a well bore formed in a formation:

injecting the injection liquid through a probe into the formation;

thermally fracturing the formation with the injection liquid, wherein the injection liquid is at a temperature lower than a temperature for the formation; and withdrawing a downhole fluid from the formation through the probe.

2. The method of claim 1, wherein the thermally fracturing comprises: lowering a temperature for a first volume of the formation adjacent the probe with the injection liquid thereby thermally contracting the first volume of the formation; and inducing tension between the first volume and a second volume of the formation adjacent the first volume.

3. The method of claim 1, the method further comprising: insulating the injection liquid in the tool to maintain the injection liquid at a temperature substantially lower than the formation.

4. The method of claim 1 wherein the liquid is ice water.

5. The method of claim 1, the method further comprising: performing a first mobility test for the formation before the thermal fracturing; performing a second mobility test for the formation after the thermal fracturing; and estimating the effect of the thermal fracturing on the formation from a comparison of the first mobility test and the second mobility test.

6. The method of claim 1, the method further comprising: learning in an expert system a temperature to induce thermal fracturing in the formation.

7. The method of claim 1, wherein the injection liquid is a completion fluid, the method further comprising:

performing a first mobility test for the formation before injecting the completion fluid into the formation;

determining a second formation fluid mobility after injecting the completion fluid into the formation; and estimating an effect of injecting the completion fluid in the formation based on a difference between the first formation fluid mobility second formation fluid mobility.

8. A system, the system comprising:

a tool containing an injection liquid storage tank positioned in a well bore formed in a formation;

an insulator adjacent the injection liquid storage tank for reducing heat flow into the injection liquid, wherein a temperature differential between the injection liquid and the formation causes a fracture in the wall bore after the injection liquid is injected into the formation;

a wire line attached to the tool; a probe in fluid communication with the formation; and a pump in fluid communication with the probe for injecting the injection liquid through the probe into the formation and withdrawing a downhole fluid from the formation through the probe.

9. The system of claim 8, the system further comprising:

a processor in data communication with a non-transitory computer readable medium containing a computer program that when executed by the processor performs a formation fluid mobility test for the formation before and after injecting the injection liquid into formation.

10. The system of claim 9, the system further comprising:

a cooling unit for maintaining the injection liquid in the injection liquid storage tank at a temperature substantially below a temperature of the formation, wherein a temperature differential between the injection liquid and the formation induces thermal fracturing in the formation when the injection liquid is injected into the formation.

11. The system of claim 10, wherein the temperature differential is sufficient to thermally fracture the formation.

12. The system of claim 8 wherein the injection fluid is ice water at a temperature of about 0 degrees Centigrade and a temperature of the formation is about 200 degrees Centigrade.

13. The system of claim 8, the system further comprising: a processor I data communication with a non-transitory computer readable medium containing a computer program that when executed by the processor performs instructions to learn in an expert system a temperature, volume and injection rate for a formation temperature to induce thermal fracturing in the formation.

14. The system of claim 8, wherein the injection liquid is a completion fluid, the system further comprising: a pump in fluid communication with the formation for withdrawing downhole fluid from the formation; and a computer program comprising computer instructions embedded in non-transitory computer readable medium that when executed by the processor performs a first formation mobility test before injecting the completion fluid into the formation and performs a second formation mobility test after injecting the completion fluid into the formation.

15. An apparatus, the apparatus comprising:

an injection liquid storage tank in fluid communication with a formation;

an insulator adjacent the injection liquid in the injection liquid storage tank at a temperature substantially below a temperature of the formation, wherein a temperature differential between the injection liquid and the formation induces thermal fracturing in the formation after the injection liquid is injected into the formation; and a pump in fluid communication with the injection liquid storage tank and a probe for injecting an injection liquid storage take through the probe into the formation and withdrawing a downhole fluid from the formation through the probe.

16. The apparatus of claim 15, the apparatus further comprising: a processor in data communication with non-transitory computer readable medium containing a computer program that when executed by the processor performs a formation fluid mobility test for the formation before and after injecting the injection fluid into the formation.

17. The apparatus of claim 15, the apparatus further comprising: a cooling unit for maintaining the injection liquid in the injection liquid storage tank at a temperature substantially below a temperature of the formation, wherein a temperature differential between the injection liquid and the formation induces thermal fracturing in the formation after the injection liquid is injected into the formation.

18. The apparatus of claim 15, the apparatus further comprising: a processor in date communication with non-transitory computer readable medium containing a computer program that when executed by the processor performs instructions to learn in an expert system running on the processor, a temperature, volume and injection rate a formation temperature to induce thermal fracturing in the formation.

19. The apparatus of claim 15, wherein the injection liquid is a completion fluid, the apparatus further comprising: a pump in fluid communication with the probe and the formation for withdrawing downhole fluid from the formation; and a computer program comprising computer instructions embedded in non-transitory computer readable medium that when executed by the processor performs a first formation mobility test before injecting the completion fluid into the formation and performs a second formation mobility test injecting the completion fluid into the formation.

* * * * *